US011330872B2

(12) United States Patent
Alcantra

(10) Patent No.: US 11,330,872 B2
(45) Date of Patent: May 17, 2022

(54) MODULAR BELT SYSTEM WITH LOW PROFILE BELT BUCKLE

(71) Applicant: 5.11, Inc., Manteca, CA (US)

(72) Inventor: Cres Alcantra, San Ramon, CA (US)

(73) Assignee: 5.11, Inc., Manteca, CA (US)

( * ) Notice: Subject to any disclaimer, the term of this patent is extended or adjusted under 35 U.S.C. 154(b) by 0 days.

(21) Appl. No.: 16/748,634

(22) Filed: Jan. 21, 2020

(65) Prior Publication Data

US 2020/0229545 A1 Jul. 23, 2020

Related U.S. Application Data

(60) Provisional application No. 62/795,850, filed on Jan. 23, 2019.

(51) Int. Cl.

| | |
|---|---|
| ***A44B 11/04*** | (2006.01) |
| ***A41F 9/00*** | (2006.01) |
| *A44B 11/24* | (2006.01) |

(52) U.S. Cl.

CPC ..... *A44B 11/04* (2013.01); *A41F 9/002* (2013.01); *A44B 11/24* (2013.01)

(58) Field of Classification Search

CPC ..... A41F 9/002; A44B 11/04; A44B 11/22; A44B 11/24

See application file for complete search history.

(56) References Cited

U.S. PATENT DOCUMENTS

| | | | | | |
|---|---|---|---|---|---|
| 1,672,325 | A | | 6/1928 | Kintz | |
| 3,085,308 | A | * | 4/1963 | Paulw | A44B 11/04 24/200 |
| 4,637,099 | A | | 1/1987 | Kasai | |
| D328,044 | S | | 7/1992 | Murai | |
| 5,307,542 | A | | 5/1994 | Murai | |
| D347,601 | S | * | 6/1994 | Anscher | D11/218 |
| 5,774,947 | A | | 7/1998 | Anshcer | |
| D421,578 | S | * | 3/2000 | Anscher | D11/218 |
| D427,547 | S | * | 7/2000 | Yoshiguchi | D11/218 |
| D446,162 | S | * | 8/2001 | Kung | D11/218 |
| D452,185 | S | * | 12/2001 | Yoshiguchi | D11/218 |
| D491,103 | S | * | 6/2004 | Uehara | D11/218 |
| D505,094 | S | * | 5/2005 | Matoba | D11/218 |
| D507,509 | S | * | 7/2005 | Hou | D11/218 |
| D536,280 | S | | 2/2007 | Wemmer | |
| D586,259 | S | | 2/2009 | Kelleghan | |
| D586,692 | S | | 2/2009 | Nykoluk | |

(Continued)

OTHER PUBLICATIONS https://wwww.firsttactical.com/products/range-belt-1-5.

(Continued)

*Primary Examiner* — David M Upchurch

(74) *Attorney, Agent, or Firm* — Knobbe Martens Olson & Bear LLP

(57) ABSTRACT

A belt has a belt buckle and a belt strap. The belt can be part of a modular belt system that provides multiple straps and/or multiple buckles that can be assembled in different combinations. Preferably, the assembly of a custom belt can be accomplished in an in-store or point-of-sale environment. In some implementations, the strap can be coupled to the buckle without sewing or other processes that require expensive machinery and/or are time consuming. In some implementations, the strap is threaded to the buckle.

18 Claims, 8 Drawing Sheets

(56) References Cited

U.S. PATENT DOCUMENTS

| | | | | | |
|---|---|---|---|---|---|
| D622,178 | S | | 8/2010 | Kelleghan | |
| D645,782 | S | | 9/2011 | Nykoluk | |
| D648,245 | S | * | 11/2011 | Takazakura | D11/218 |
| D648,653 | S | * | 11/2011 | Kadoishi | D11/218 |
| D668,580 | S | * | 10/2012 | Kax | D11/218 |
| D670,197 | S | * | 11/2012 | Kelleghan | D11/218 |
| D672,280 | S | | 12/2012 | Schurian et al. | |
| D686,059 | S | * | 7/2013 | Paik | D8/356 |
| D703,097 | S | * | 4/2014 | Nanbu | D11/218 |
| 8,898,870 | B2 | | 12/2014 | Chan | |
| D741,148 | S | | 10/2015 | Liu | |
| D782,364 | S | | 3/2017 | Nykoluk | |
| D804,937 | S | * | 12/2017 | Paik | D8/356 |
| D823,717 | S | | 7/2018 | Ho | |
| D847,016 | S | | 4/2019 | Stringham | |
| D858,349 | S | | 9/2019 | Ishii | |
| D890,022 | S | | 7/2020 | Alcantra | |

OTHER PUBLICATIONS

TDU Low Pro Belt, No date available, [online] [site visited Mar. 12, 2020]. Retrieved from url: https://www.511tactical.com/low-prp-tdu-belt.html (Year: 2020).

Enniu Tactical Belt, Oct. 22, 2019, [online], [site visited Mar. 12, 2020]. Retrieved from url:https://www.gearbest.com/women-s-belts/pp_009796993753.html (Year: 2019).

* cited by examiner

MODULAR BELT SYSTEM WITH LOW PROFILE BELT BUCKLE

BACKGROUND

Field

The present disclosure relates to waist belts. In particular, the present disclosure relates to a modular belt system.

Description of Related Art

Waist belts have been long used for functional or aesthetic purposes. In general, belts include a strap of material (e.g., leather, nylon) and a buckle that is permanently attached to the strap.

SUMMARY

Such prior belt arrangements are not amenable to in-store customization of the belt. Therefore, a need exists for a modular belt system that provides multiple straps and/or multiple buckles that can be assembled in different combinations, preferably in an in-store or point-of-sale environment. In some implementations, the strap can be coupled to the buckle without sewing or other processes that require expensive machinery and/or are time consuming.

The systems, methods and devices described herein have innovative aspects, no single one of which is indispensable or solely responsible for their desirable attributes. Without limiting the scope of the claims, some of the advantageous features will now be summarized.

In some implementations, a belt buckle comprises a body having a perimeter portion, which defines an interior space. The body further comprises a first crossbar portion and a second crossbar portion. The first and second crossbar portions are spaced from one another and each extends from one side of the perimeter portion to an opposing side of the perimeter portion. The perimeter portion defines an outward-facing surface and an inward-facing surface opposite the outward-facing surface. The outward-facing surface defines a perimeter edge along the interior space. Each of the first and second crossbar portions define an outward-facing surface that is located between the outward-facing surface and the inward-facing surface of the perimeter portion. An outward-most portion of the outward-facing surface of the second crossbar portion is spaced further from the perimeter edge and/or the outward-facing surface of the perimeter portion than an outward-most portion of the outward-facing surface of the first crossbar portion.

In some implementations, each of the first and second crossbar portions define an inward-facing surface, each of which are spaced inwardly from the inward-facing surface of the perimeter portion.

In some implementations, the inward-facing surfaces of the first and second crossbar portions lie in a single plane.

In some implementations, the outward-facing surface of one or both of the first and second crossbar portions is angled relative to a perimeter plane defined by the perimeter edge and/or a plane defined by the inward-facing surface of the one or both of the first and second crossbar portions.

In some implementations, the outward-facing surfaces of the first and second crossbar portions are angled toward one another such that adjacent portions are closer to the perimeter edge and/or the outward-facing surface of the perimeter portion than opposing portions.

In some implementations, the outward-facing surface of the perimeter portion is outwardly curved from end portions toward a center portion when viewed from the side.

In some implementations, the perimeter portion comprises a finger tab.

In some implementations, opposing side surfaces of the perimeter portion comprises a textured finger grip surface.

In some implementations, the inward-facing surface comprises a plurality of recesses.

In some implementations, an interior surface and/or the inward-facing surface of an end of the perimeter portion comprises a plurality of grip protrusions configured to engage an associated belt strap.

In some implementations, a belt strap is woven through the interior space and around the crossbars to both connect the belt strap to the belt buckle and to adjust a perimeter length of the belt strap.

In some implementations, a method of point-of-sale customization of a belt comprises obtaining one of a plurality of available belt straps, obtaining a belt buckle, and assembling the belt strap to the belt buckle without sewing.

In some implementations, the assembly of the belt strap to the belt buckle comprises threading the belt strap to the belt buckle.

In some implementations, the method comprises obtaining the belt buckle from a plurality of available belt buckles.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 2:
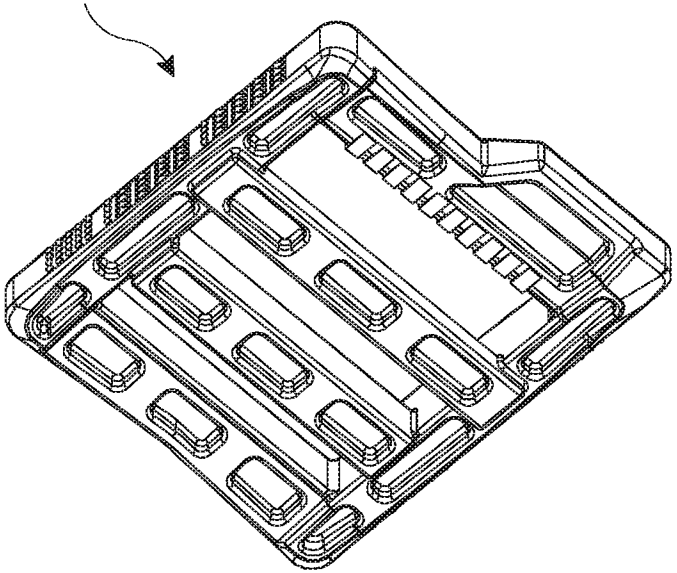
FIG. 2 is a rear perspective view of the belt buckle of FIG. 1.
Figure 1:
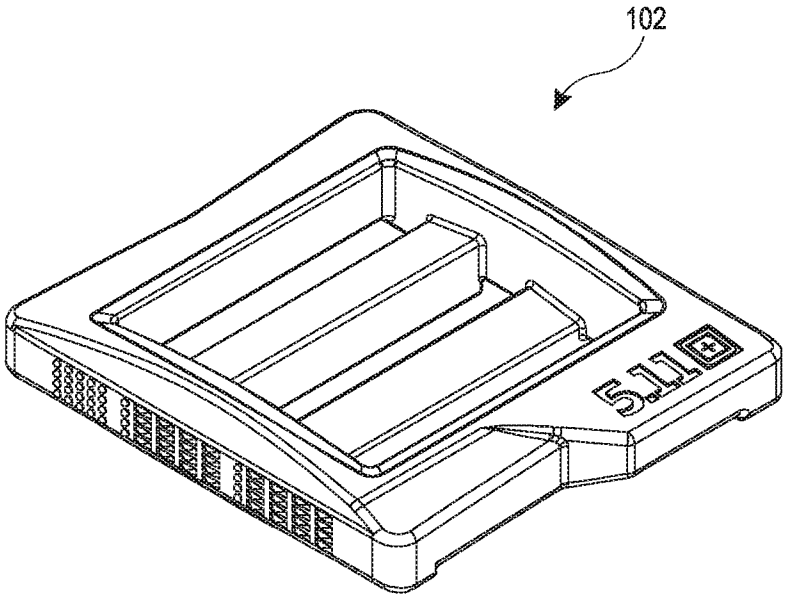
FIG. 1 is a front perspective view of a belt buckle of a belt assembly.
Figure 4:
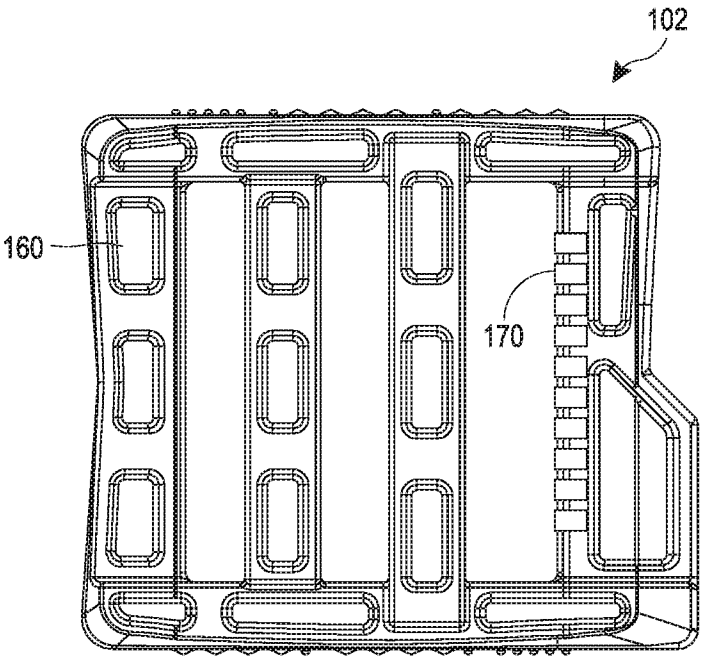
FIG. 4 is a rear view of the belt buckle of FIG. 1.
Figure 3:
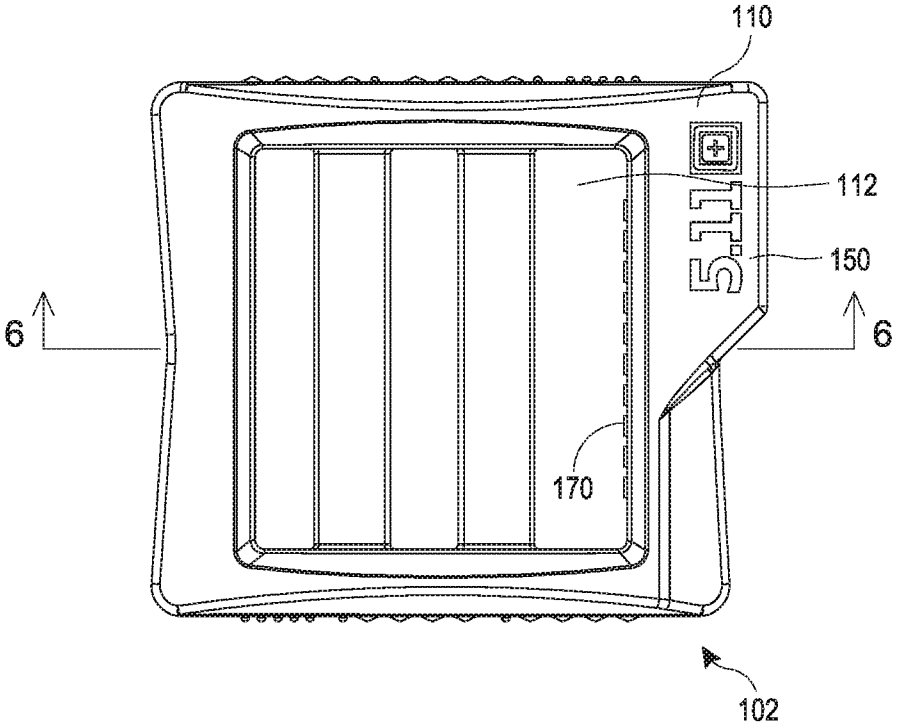
FIG. 3 is a front view of the belt buckle of FIG. 1.
Figure 5:
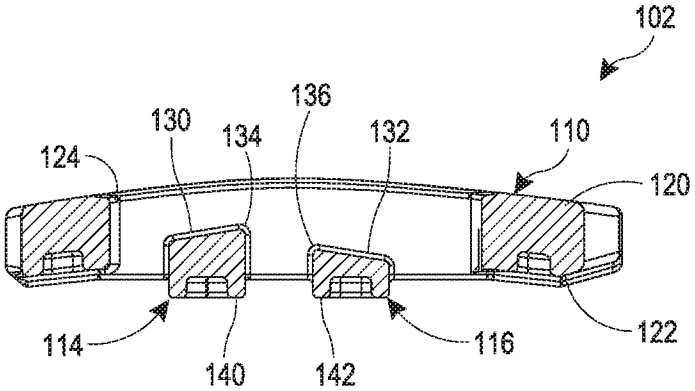
FIG. 5 is sectional view of the belt buckle of FIG. 1 taken along the line 5-5 of FIG. 3.
Figure 6:
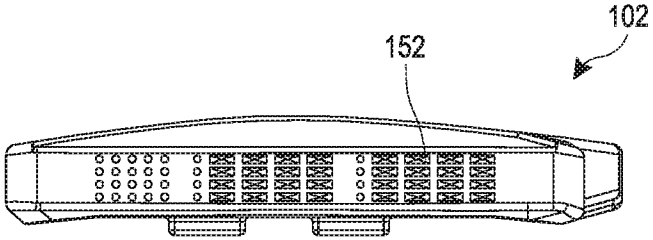
FIG. 6 is a side view of the belt buckle of FIG. 1.

Embodiments of systems, components and methods of assembly and manufacture will now be described with reference to the accompanying Figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described. Dimensions included in the drawings are by way of example only and are not intended to be limiting unless recited in the claims.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1-8 illustrate a belt 100 having a belt buckle 102 and a belt strap 104. The belt 100 can be part of a modular belt system that provides multiple straps and/or multiple buckles that can be assembled in different combinations. Preferably, the assembly of a custom belt can be accomplished in an in-store or point-of-sale environment. In some implementations, the strap 104 can be coupled to the buckle 102 without sewing or other processes that require expensive machinery and/or are time consuming. In some implementations, the strap 104 is threaded to the buckle 102.

In some implementations, the belt buckle 102 comprises a body having a perimeter portion 110, which defines an interior space 112. The body further comprises a first crossbar portion 114 and a second crossbar portion 116. The first and second crossbar portions 114, 116 are spaced from one another and each extends from one side of the perimeter portion 110 to an opposing side of the perimeter portion 110. In the illustrated arrangement, each of the first and second crossbar portions 114, 116 are linear and are oriented perpendicular to sides of the perimeter portion 110, which can also be linear.

In the illustrated arrangement, the perimeter portion 110 defines an outward-facing surface 120 and an inward-facing surface 122 opposite the outward-facing surface 120. The outward-facing surface 120 defines a perimeter edge 124 along the interior space 112. Each of the first and second crossbar portions 114, 116 define an outward-facing surface 130, 132 that is located between the outward-facing surface 120 and the inward-facing surface 122 of the perimeter portion 110. An outward-most portion 136 of the outward-facing surface 132 of the second crossbar portion 116 is spaced further from the perimeter edge 124 and/or the outward-facing surface 120 of the perimeter portion 110 than an outward-most portion 134 of the outward-facing surface 130 of the first crossbar portion 114.

In the illustrated arrangement, each of the first and second crossbar portions 114, 116 define an inward-facing surface 140, 142, each of which are spaced inwardly from the inward-facing surface 122 of the perimeter portion 110. The inward-facing surfaces 140, 142 of the first and second crossbar portions 114, 116 can lie in a single plane. With such an arrangement, the second crossbar portion 116 can have a greater thickness than the first crossbar portion 114.

In some implementations, the outward-facing surface 130, 132 of one or both of the first and second crossbar portions 114, 116 is angled relative to a perimeter plane defined by a linear portion of the perimeter edge 124, a plane defined by the inward-facing surface 140, 142 of the one or both of the first and second crossbar portions 114, 116 and/or an arbitrary plane bisecting the buckle 102 in a thickness direction. In some implementations, the outward-facing surfaces 130, 132 of the first and second crossbar portions 114, 116 are angled to face toward the adjacent end of the perimeter portion 110 such that adjacent portions are closer to the perimeter edge 124 and/or the outward-facing surface 120 of the perimeter portion 110 than opposing portions. Such an arrangement can facilitate threading of the belt strap 104 onto the buckle 102, while also providing a desirable retention force of the belt strap 104 within the buckle 102.

In the illustrated buckle 102, the outward-facing surface of the perimeter portion 110 is outwardly curved from end portions toward a center portion when viewed from the side. Such an arrangement can provide the buckle 102 and associated belt 100 with an attractive appearance.

In the illustrated arrangement, the perimeter portion comprises a finger tab 150, which can be configured to allow a user to manipulate the buckle 102 with his or her finger to ease threading or unthreading of the belt strap 104 to or from the buckle 102. While the finger tab 150 can have many different shapes and configurations from a functional standpoint, the illustrated finger tab 150 provides the buckle 102 with a desirable and/or distinct appearance.

In some implementations, opposing side surfaces of the perimeter portion 110 each comprises a textured finger grip surface 152. The textured finger grip surface 152 can be configured to facilitate grasping of the buckle 102 by the user. In the illustrated arrangement, the textured finger grip surface 152 comprises a plurality of protrusions. In some implementations, the protrusions can be of varied size (e.g., height, length and/or width). In the illustrated buckle 102, each of the side surfaces of the perimeter portion 110 on which the finger grip surfaces 152 are located is flat or substantially flat. In other arrangements, however, the side surfaces or the surfaces on which the finger grip surfaces 152 are located can be curved in one or more directions.

In some implementations, the inward-facing surface comprises a plurality of recesses 160. The recesses 160 can be located in any one or any combination of the perimeter portion 110, the first crossbar 114 and the second crossbar 116. In the illustrated arrangement, the recesses 160 are located in each of the perimeter portion 110, the first crossbar 114 and the second crossbar 116. The recesses 160 can be provided to reduce the weight and/or material usage of the buckle 102, or to improve the ability to mold the buckle 102, relative to designs without recesses 160.

In some implementations, an interior surface and/or the inward-facing surface 122 of an end of the perimeter portion 110 comprises a friction-enhancing surface, which in the illustrated arrangement is in the form of a plurality of grip protrusions 170, configured to engage an associated belt strap 104 and inhibit or prevent undesired sliding movement of the belt strap 104 relative to the buckle 102. In the illustrated arrangement, the grip protrusions 170 are on the same end as the finger tab 150. In the illustrated arrangement, the friction-enhancing surface or grip protrusions 170 are located on both the interior surface of the end of the perimeter portion 110 and the inward-facing surface 122 of the end of the perimeter portion 110.

Figure 7:
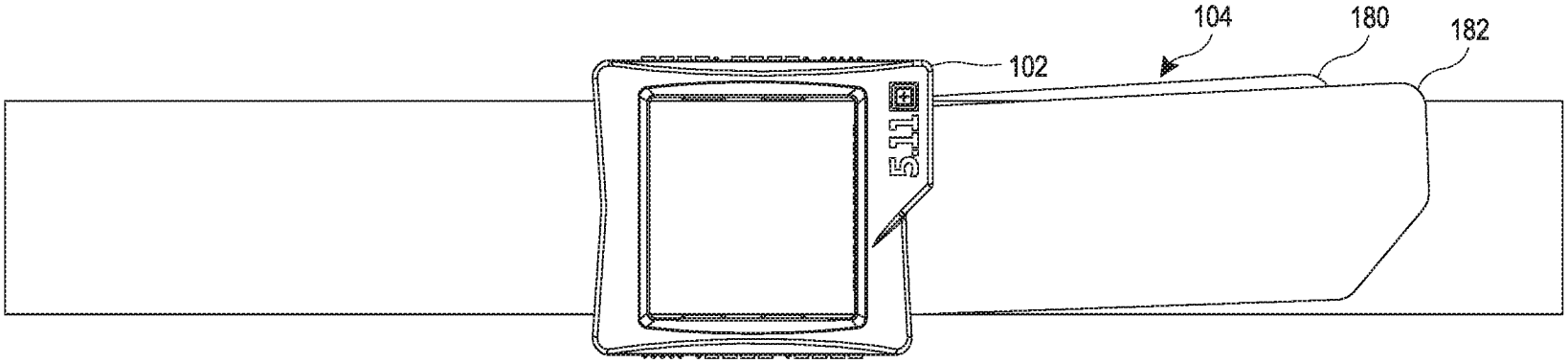
FIG. 7 is a front view of a belt assembly including the belt buckle of FIG. 1 and a belt strap.
Figure 8:
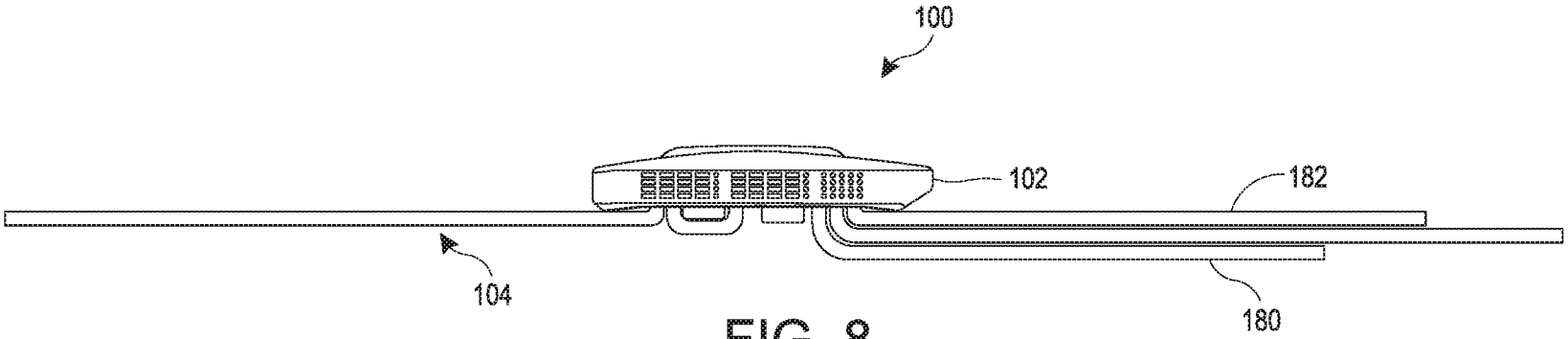
FIG. 8 is a side view of the belt assembly of FIG. 7.

FIGS. 7 and 8 illustrates the belt 100 that includes the belt strap 104 attached to the belt buckle 102. In the illustrated arrangement, the strap 104 is woven through the interior space 112 and around one or both of the crossbars 114, 116 to both connect the belt strap 104 to the belt buckle 102 and to adjust a perimeter length of the belt strap 104. In particular, to assemble the strap 104 to the buckle 102, a first end portion 180 of the strap 104 is passed from the inward-facing surface 122 through the interior space 112 between the second crossbar 116 and the adjacent end of the perimeter portion 110 and across the outward-facing surfaces 132, 130 of the second crossbar 116 and the first crossbar 114. The first end portion 180 is then passed from the outward-facing surface 120 through the interior space 112 between the first crossbar 114 and the adjacent end of the perimeter portion 110. The first end portion 180 is then passed over the inward-facing surface 140 of the first crossbar 114 and from the inward-facing surface 122 between the first crossbar 114 and the second crossbar 116 toward the outward-facing surface 120. The first end portion 180 is then passed over the outward-facing surface 132 of the second crossbar 116 between the second crossbar 116 and the portion of the first end portion 180 previously threaded through the buckle 102. The first end portion 180 is then passed from the outward-facing surface 120 through the interior surface 112 to the inward-facing surface 120 and back toward the end of the perimeter portion 110 through which the first end portion 180 was initially inserted into the buckle 102 or toward the finger tab 150 end of the perimeter portion 110.

With such an arrangement, the strap 104 can be coupled to the buckle 102 in a simple manner. The illustrated arrangement can permit coupling of the strap 104 to the buckle 102 without a sewn joint or other permanent connection. Furthermore, no expensive or dedicated equipment is necessary to secure the strap 104 to the buckle 102. If desired, the first end portion 180 can be trimmed so that the strap 104 doesn't have an excessive amount of extra strap 104. If necessary or desirable, the trimmed end of the strap 104 can be processed (e.g., heated) to avoid unraveling of the filaments of the strap 104. The strap 104 can also be provided in bulk and cut to a desired size with one or both ends processed, if necessary or desired.

To adjust a perimeter length of the belt 100—or, in other words, to use the belt 100—a second end 182 of the strap 104 is passed from the inward-facing surface 122 through the interior space 112 between the first crossbar 114 and the adjacent end of the perimeter portion 110, across the first and second crossbars 114, 116 and back through the interior space 112 between the second crossbar 116 and the adjacent end of the perimeter portion 110. The first end 180 of the strap 104 is positioned between the second end 182 of the strap 104 and the first and second crossbars 114, 116 such that the first end 180 of the strap 104 helps guide the second end 182 of the strap 104 through the buckle 102.

In some implementations, a method of point-of-sale customization of a belt 100 includes obtaining one of a plurality of available belt straps 104, obtaining a belt buckle 102, and assembling the belt strap 104 to the belt buckle 102. Preferably, the assembling of the belt strap 104 to the belt buckle 102 occurs without sewing or other means of permanent connection of the strap 104 to the buckle 102. In some configurations, the method may include permanent connection of the strap 104 to the buckle 102; however, preferably the method of connection does not require expensive equipment, such that the method can be completed on-demand in a retail environment. In some implementations, the method comprises obtaining the belt buckle 102 from a plurality of available belt buckles 102. The available selection of belt buckles 102 and/or belt straps 104 can vary in color, material, size, shape, texture or other characteristics to provide the ability for the purchaser or end user to select a custom belt 100. In some implementations, the assembly of the belt strap 104 to the belt buckle 102 comprises threading the belt strap 104 to the belt buckle 102. In some implementations, the belt strap 104 is threaded to the belt buckle 102 as described above.

Figure 9A:
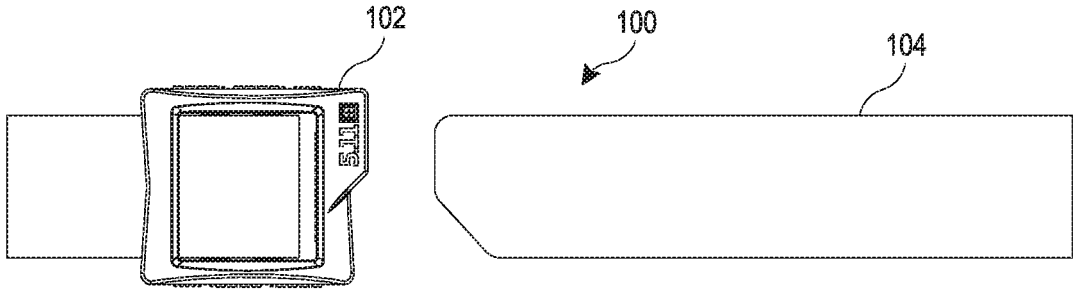
FIGS. 9*a*, 9*b* and 9*c* illustrate several belts having belt straps of various colors.
Figure 9B:
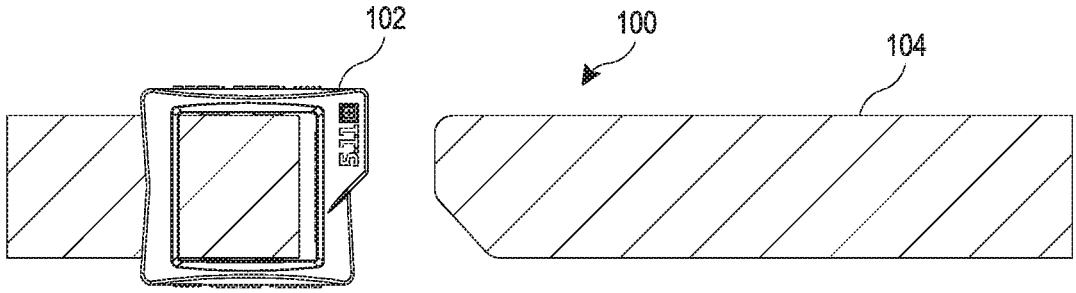
Figure 9C:
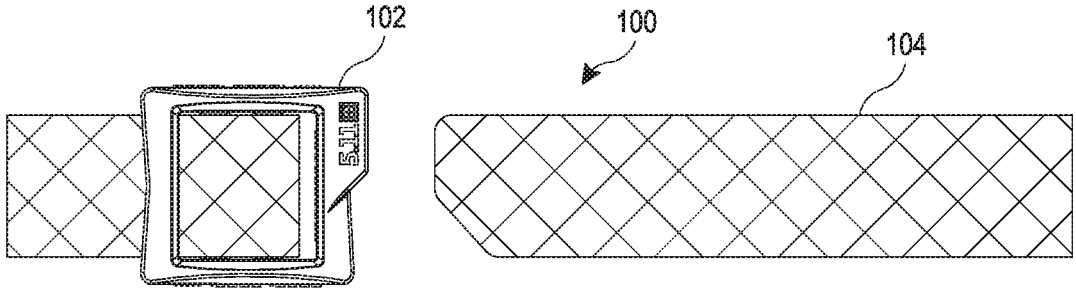
Figure 10E:
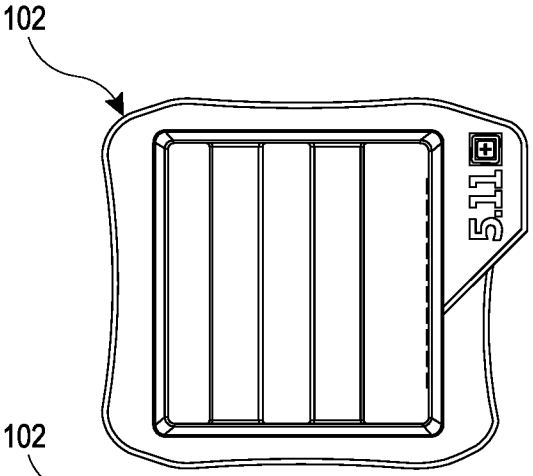
FIGS. 10*e*, 10*f*, 10*g* and 10*h* illustrate a second alternative belt buckle having an outer shape that differs from the outer shape of the buckle of FIGS. 1-8.
Figure 10F:
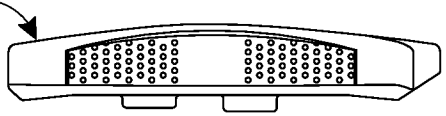
Figure 10G:
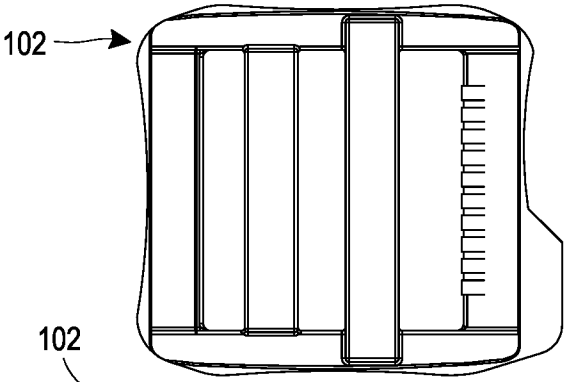
Figure 10H:
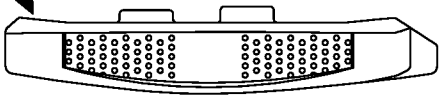
Figure 10A:
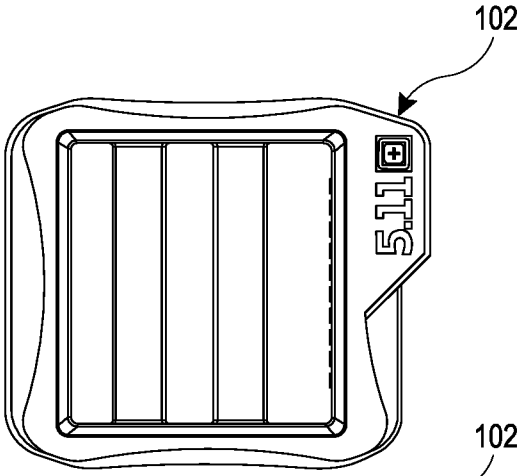
FIGS. 10*a*, 10*b*, 10*c* and 10*d* illustrate a first alternative belt buckle having an outer shape that differs from the outer shape of the buckle of FIGS. 1-8.
Figure 10B:
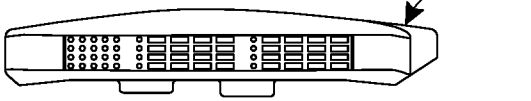
Figure 10C:
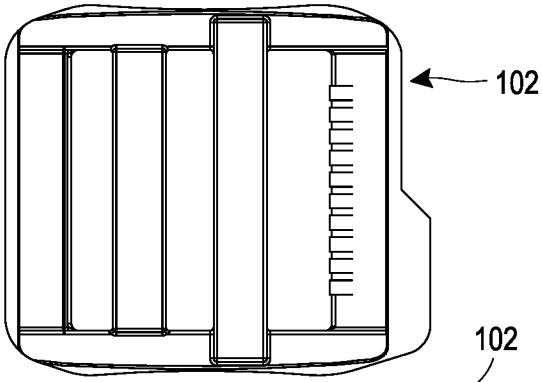
Figure 10D:
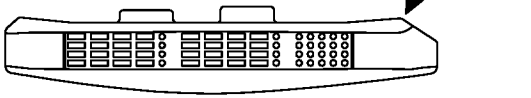
Figure 11:
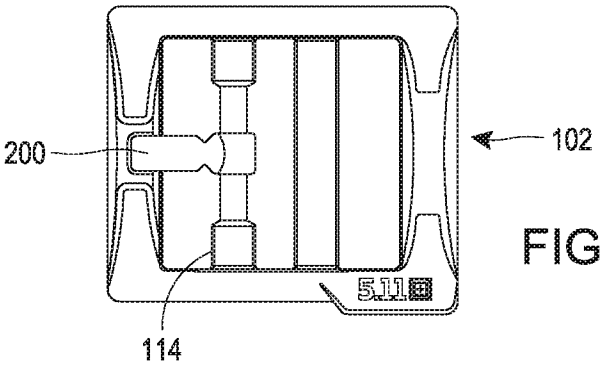
FIG. 11 is a front view of a belt buckle with a prong that engages an opening of an associated belt strap.
Figure 12:
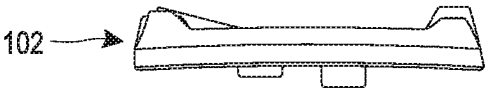
FIG. 12 is a side view of the belt buckle of FIG. 11.
Figure 13:
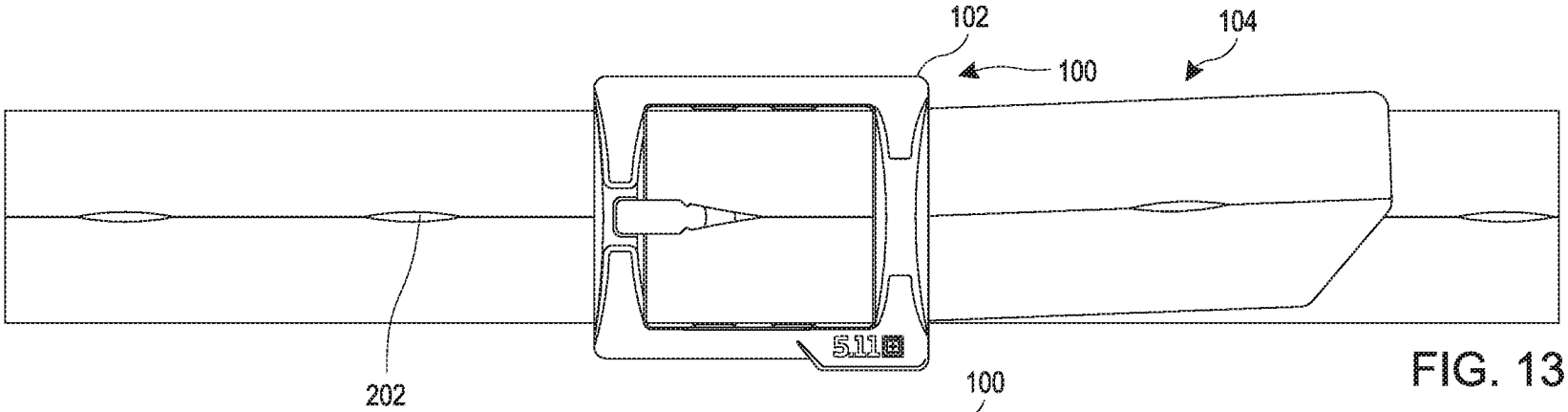
FIG. 13 is a front view of a belt assembly comprising the belt buckle of FIG. 11 and a belt strap.
Figure 14:
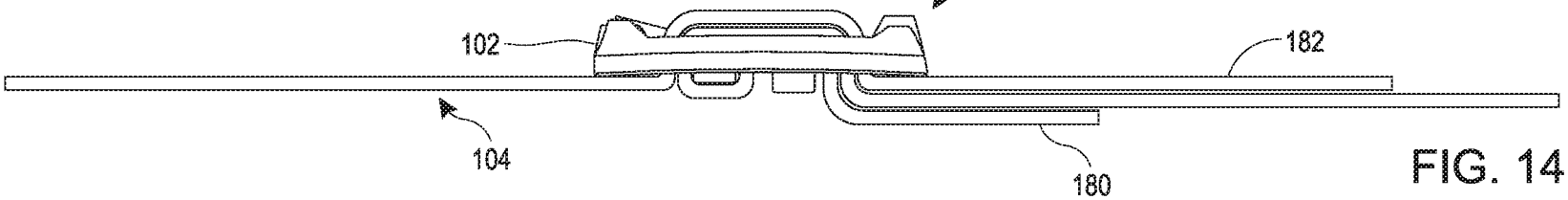
FIG. 14 is a side view of the belt assembly of FIG. 13.
Figure 15:
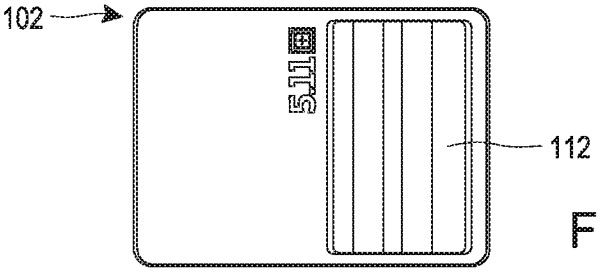
FIG. 15 is a front view of a belt buckle with a hook or pin that engages an opening of an associated belt strap.
Figure 16:
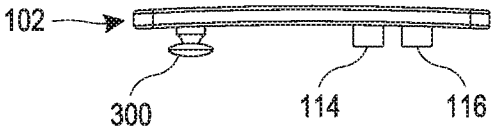
FIG. 16 is a side view of the belt buckle of FIG. 15.
Figure 17:
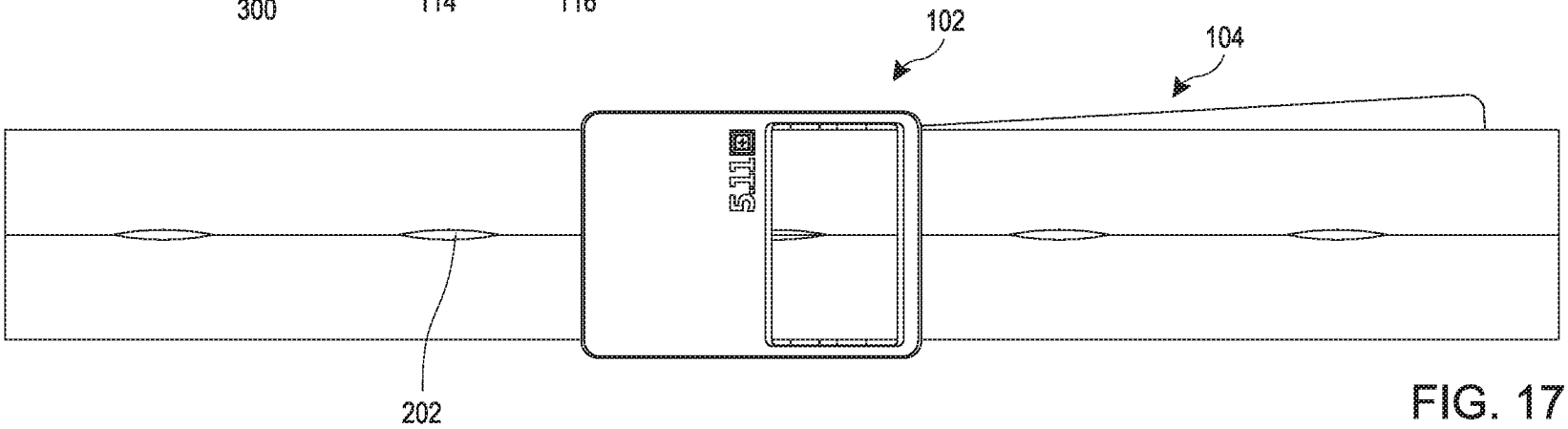
FIG. 17 is a side view of a belt assembly comprising the belt buckle of FIG. 15 and a belt strap.
Figure 18:
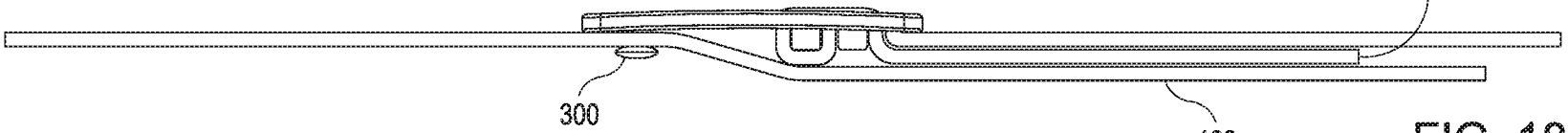
FIG. 18 is a side view of the belt assembly of FIG. 17.

FIGS. 9*a*, 9*b* and 9*c* illustrate several options of the belt 100 of FIGS. 1-8. Each of the illustrated belts 100 includes a belt buckle 102 of one color (e.g., black). The color of the belt strap 104 varies between the illustrated belts 100. Thus, a purchaser can select a desired color of the belt strap 104. In some configurations, as described above, the selected belt strap 104 can be assembled to the belt buckle 102 at the point-of-sale. In some configurations, the belt buckle 102 can be provided in multiple colors or another characteristic (e.g., size, shape or material).

FIGS. 10*a*-10*d* and 10*e*-10*h* illustrate two different belt buckles 102, respectively, that can vary in outer shape from one another and from the buckle 102 of FIGS. 1-8. In other respects, the buckles 102 can be the same or similar. For example, all the illustrated buckles 102 can have internal structures that are the same as or similar to the buckle 102 of FIGS. 1-8. The belt strap 104 can be assembled to the belt buckles 102 in the same manner as described with respect to FIGS. 1-8.

FIGS. 11-14 illustrates a belt 100 that is similar to the belts 100 described with respect to FIGS. 1-10. The belt strap 104 can be assembled to the belt buckle 102 in the same manner as described with respect to FIGS. 1-8. However, the illustrated belt buckle 102 includes a prong 200 configured to pass through a selected one of a plurality of openings 202 of the belt strap 104. The prong 200 can be rotatably supported on the first crossbar portion 114. At least a center portion of the first crossbar portion 114 is circular in cross-sectional shape to allow for rotation of the prong 200.

FIGS. 15-18 illustrates another belt 100 in which the belt buckle 102 includes a hook or pin 300 that is configured to pass through a selected one of the plurality of openings 202 of the belt strap 104. The pin 300 can be a mushroom-shaped pin 300 having a smaller diameter shaft portion and an enlarged head portion configured for insertion through the opening 202 and then to resist unintentional removal from the opening 202. The belt strap 104 can be assembled to the belt buckle 102 in the same or substantially the same manner as described in connection with FIGS. 1 and 2; however, the loose end, adjustable end or second end 182 of the belt strap 104 is not passed through the interior space 112 of the buckle 102. Instead, the second end 182 is passed behind the buckle

102 (on the side closest to the wearer) and can be secured to the buckle 102 via connection between the pin 300 and opening 202.

The belts 100 of FIGS. 11-18 can be provided in several combinations of belt buckles 102 and/or belt straps 104. For example, the belt straps 104 can be provided in different colors, materials or textures. The belt buckle 102 can be provided in different colors, materials or shapes. A custom combination of the buckle 102 and strap 104 can be assembled at the point-of-sale specifically for the purchaser.

CONCLUSION

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A belt buckle, comprising:

a body having a perimeter portion, which defines an interior space, the body further comprises a first crossbar portion and a second crossbar portion, the first and second crossbar portions are spaced from one another and each extends from one side of the perimeter portion to an opposing side of the perimeter portion, the perimeter portion defines an outward-facing surface and an inward-facing surface opposite the outward-facing surface, the outward-facing surface defines a perimeter edge along the interior space, each of the first and second crossbar portions defines a ramped outward-facing surface that is located between the outward-facing surface and the inward-facing surface of the perimeter portion, an outward-most portion of the ramped outward-facing surface of the second crossbar portion is spaced further from the perimeter edge and/or the outward-facing surface of the perimeter portion than an outward-most portion of the ramped outward-facing surface of the first crossbar portion, and wherein the outward-most portions of the ramped outward-facing surfaces are located adjacent one another and are located inward of an entirety of the outward-facing surface of the perimeter portion.

2. A belt buckle, comprising:

a body having a perimeter portion, which defines an interior space, the body further comprises a first crossbar portion and a second crossbar portion, the first and second crossbar portions are spaced from one another and each extends from one side of the perimeter portion to an opposing side of the perimeter portion, the perimeter portion defines an outward-facing surface and an inward-facing surface opposite the outward-facing surface, the outward-facing surface defines a perimeter edge along the interior space, each of the first and second crossbar portions define an outward-facing surface that is located between the outward-facing surface and the inward-facing surface of the perimeter portion, an outward-most portion of the outward-facing surface of the second crossbar portion is spaced further from the perimeter edge and/or the outward-facing surface of the perimeter portion than an outward-most portion of the outward-facing surface of the first crossbar portion;

wherein each of the first and second crossbar portions define an inward-facing surface, each of which are spaced inwardly from the inward-facing surface of the perimeter portion at a junction between each of the first and second crossbar portions and the perimeter portion.

3. The belt buckle of claim 2, wherein the inward-facing surfaces of the first and second crossbar portions lie in a single plane.

4. The belt buckle of claim 1, wherein the ramped outward-facing surface of one or both of the first and second crossbar portions is angled relative to a perimeter plane defined by the perimeter edge and/or a plane defined by the inward-facing surface of the one or both of the first and second crossbar portions.

5. The belt buckle of claim 1, wherein the outward-facing surface of the perimeter portion is outwardly curved when viewed from the side.

6. The belt buckle of claim 1, wherein the perimeter portion comprises a finger tab.

7. The belt buckle of claim 1, wherein opposing side surfaces of the perimeter portion comprises a textured finger grip surface.

8. The belt buckle of claim 1, wherein the inward-facing surface comprises a plurality of recesses.

9. The belt buckle of claim 1, wherein an interior surface and/or the inward-facing surface of an end of the perimeter portion comprises a plurality of grip protrusions configured to engage an associated belt strap.

10. The belt buckle of claim 1, wherein a belt strap is woven through the interior space and around the crossbars to both connect the belt strap to the belt buckle and to adjust a perimeter length of the belt strap.

11. A belt buckle, comprising:

a body having a perimeter portion, which defines an interior space, the body further comprises:

a first crossbar portion; and a second crossbar portion, wherein the first and second crossbar portions are the only crossbar portions within the interior space of the body and the body has exactly three passages extending between the outward-facing surface and the inward-facing surface through which a belt strap can pass, the first and second crossbar portions are spaced from one another and each extends from one side of the perimeter portion to an opposing side of the perimeter portion, the perimeter portion defines an outward-facing surface and an inward-facing surface opposite the outward-facing surface, the outward-facing surface defines a perimeter edge along the interior space, each of the first and second crossbar portions define an outward-facing surface that is located between the outward-facing surface and the inward-facing surface of the perimeter portion, an outward-most portion of the outward-facing surface of the second crossbar portion is spaced further from the perimeter edge and/or the outward-facing surface of the perimeter portion than an outward-most portion of the outward-facing surface of the first crossbar portion.

12. The belt buckle of claim 11, wherein the perimeter portion comprises a finger tab.

13. The belt buckle of claim 11, wherein opposing side surfaces of the perimeter portion comprises a textured finger grip surface.

14. The belt buckle of claim 11, wherein the inward-facing surface comprises a plurality of recesses.

15. The belt buckle of claim 11, wherein an interior surface and/or the inward-facing surface of an end of the perimeter portion comprises a plurality of grip protrusions configured to engage an associated belt strap.

16. The belt buckle of claim 11, wherein a belt strap is woven through the interior space and around the crossbars to both connect the belt strap to the belt buckle and to adjust a perimeter length of the belt strap.

17. The belt buckle of claim 11, wherein the perimeter portion comprises a first end and a second end, both perimeter portion ends comprising an end surface that is located on the end of the body and a center facing surface that faces a center of the buckle, both end portions being solid from their end most surface to their center facing surface.

18. The belt buckle of claim 2, wherein the inward-facing surface of the first and second crossbar portions are both spaced inwardly of a remainder of the body.

* * * * *